United States Patent [19]

Lipsztajn

[11] Patent Number: 4,802,959

[45] Date of Patent: Feb. 7, 1989

[54] ELECTROSYNTHESIS OF PERSULFATE

[75] Inventor: Marek Lipsztajn, Rexdale, Canada

[73] Assignee: Tenneco Canada Inc., Islington, Canada

[21] Appl. No.: 62,637

[22] Filed: Jun. 16, 1987

[51] Int. Cl.[4] ..... C25B 1/28

[52] U.S. Cl. ..... 204/82; 204/294

[58] Field of Search ..... 204/294, 82

[56] References Cited

U.S. PATENT DOCUMENTS 4,144,144 3/1979 Radimer et al. ..... 204/93

4,235,695 11/1980 de Nora et al. ..... 204/98

FOREIGN PATENT DOCUMENTS 1231084 5/1986 U.S.S.R. .

OTHER PUBLICATIONS

"Adodic Evolution of Ozone"-J. Electrochem. Soc.; Mar., 1982-pp. 506-515.

J. Balej et al-"Electrochemical Reactors"-Fortschritte der Verfahrenstechnik-(Prog. Chem. Engineering) Section D, 22 (1984), pp. 361 to 389.

*Primary Examiner*—T. Tung

*Assistant Examiner*—Kathryn Gorgos

*Attorney, Agent, or Firm*—Sim & McBurney

[57] ABSTRACT

Peroxydisulfuric acid and its salts are produced electrochemically from an aqueous acid sulfate solution using a glassy carbon anode in the presence of fluoride ions dissolved in the anolyte. A low cost alternative to platinum is provided and high current efficiencies are obtained.

12 Claims, No Drawings

ELECTROSYNTHESIS OF PERSULFATE

FIELD OF INVENTION

The present invention relates to the electrosynthesis of persulfate.

BACKGROUND TO THE INVENTION

Inorganic peroxy compounds are very strong oxidants used mainly in textile bleaching, metal cleaning and etching solutions as well as emulsion polymerization initiators. Such compounds can be manufactured electrochemically and, indeed, the only commercial method of preparation for peroxydisulfuric acid and peroxydisulfates (commonly abbreviated as "persulfate") is electrochemical, with platinum being used as the anode material. The state of the art with respect to the commercial production of peroxydisulfates is set forth in a review article entitled "Electrochemical Reactors" by Jan Balej et al, appearing in Fortschritte der Verfahrenstechnik (Prog. Chem. Engineering), Section D, 22 (1984), p361 to 389.

Attempts have been made to use cheaper materials to substitute for the expensive platinum anodes. Beta-lead dioxide and various dimensionally-stable anodes have been tested but none exhibited standtime under the extreme conditions of persulfate electrosynthesis.

In USSR Patent No. 1,231,084, there is disclosed a process for the electrosynthesis of ammonium peroxydisulfate by electrolysis of an acidified solution of ammonium sulfate using highly conductive thermoanthracite as the anode in the presence of 0.05 to 0.6 moles per litre of ammonium fluoride.

SUMMARY OF INVENTION

It has now surprisingly been found that peroxydisulfuric acid and peroxydisulfates of high purity can be obtained at high current efficiency using a glassy carbon anode, so long as a small amount of a fluoride is present in the anolyte.

The use of various additives, including fluorides, in the conventional electrosynthesis of persulfate using platinum anodes to improve current efficiency is well known and a variety of materials are described in the above review article. In the present invention, where a glassy carbon anode is used, only fluorides are effective and such known additives as ammonium thiocyanate, thiourea and fluoroboric acid are ineffective.

Essential to the present invention is the use of glassy carbon as the anode material. Glassy carbon is a well-known electrode material which is available from commercial sources but has not been used heretofore in the electrosynthesis of persulfates. Glassy carbon is formed by baking a novoloid-resole composite at high temperature over an extended period of time to carbonize the composite to form a uniform, amorphous, glassy or vitreous carbon in which the portions formerly comprising fiber and matrix are virtually indistinguishable.

The process of the invention is specific for the production of peroxydisulfuric acid and salts thereof and is ineffective for producing other electrochemically-produced inorganic peroxy compounds, including peroxydiphosphate and perborate.

Accordingly, the present invention provides a method for the production of peroxydisulfuric acid or a salt thereof, which comprises electrolyzing an aqueous acid reaction medium containing sulfate ions using an anode having a glassy carbon surface in the presence of an oxygen evolution-inhibiting amount of fluoride ions in the reaction medium to form peroxydisulfate ions at the anode.

GENERAL DESCRIPTION OF INVENTION

In the present invention, peroxydisulfuric acid or its salts are produced by electrolysis of an aqueous acid reaction medium containing sulfate ions. The reaction medium is required to be acidic, usually at a pH below about 5. At higher pH values, degradation of the glassy carbon anode occurs.

The sulfate ions which are present in the reaction medium may be provided by sulfuric acid, sulfate salts, or a combination thereof. Among the sulfate salts which may be employed, ammonium sulfate is preferred in view of its solubility, but other sulfate salts, such as sodium or potassium sulfate, may be employed. The concentration of sulfate ions present in the reaction medium from sulfate salts usually ranges from about 10 to about 800 gpL, preferably about 300 to about 600 gpL. When sulphate salts which are essentially neutral are employed, sulphuric acid is added to acidify the reaction medium to the required acid pH range.

When sulphuric acid provides all or part of the sulphate ions, the concentration of sulphuric acid in the reaction medium may range from about 1 to about 12 molar, preferably about 3 to about 12 molar, more particularly from about 5 to about 8 molar.

From such aqueous acid reaction medium, peroxydisulfuric acid or its salts is formed by anodic electrolysis at high current efficiencies using a glassy carbon anode. The current efficiencies which are obtained in the present invention exceed about 80% and, therefore, are comparable to those commercially obtained using platinum anodes. The anode usually is constructed wholly of glassy carbon, although it is sufficient that the anode surface be of glassy carbon material.

In the electrosynthesis of peroxydisulfuric acid, the electrochemical reactions which are carried may be represented as follows:

$$\text{Anode:}\quad 2SO_4^{=} - 2e \longrightarrow S_2O_8^{=}$$

$$\text{Cathode:}\quad 2H_2O + 2e \longrightarrow H_2 + 2OH^-$$

$$\text{Cell:}\quad 2H_2O + 2SO_4^{=} \longrightarrow S_2O_8^{=} + H_2 + 2OH^-$$

There is also a competing reaction at the anode which produces oxygen:

$$H_2O - 2e \rightarrow \tfrac{1}{2}O_2 + 2H^+$$

The current efficiency is determined in relation to conversion of sulfate ions to peroxydisulfate ions and any inefficiency results from oxygen formation or persulfate decomposition.

In the present invention, the satisfactory current efficiencies i.e. in excess of 80%, often in excess of 90%, are obtained with the glassy carbon anode only when fluoride ions also are present in the anolyte. In the absence of such additive, the glassy carbon anode rapidly undergoes physical deterioration as a result of oxidation by anodically-produced oxygen. The instability of glassy carbon anodes polarized to highly anodic potentials in sulphuric acid has been reported in the literature, in P. C. Foller et al, J. Electrochem. Soc. 129 (1982), pp.506 to 515.

The presence of an oxygen evolution-inhibiting amount of fluoride ions in the anolyte not only enables high current efficiencies to be obtained but also protects the glassy carbon anode from physical deterioration.

Although various substances have previously been suggested to be added during the electrosynthesis of persulfate using a platinum anode, only fluoride ions are effective in obtaining the desired current efficiencies and electrode protection when a glassy carbon anode is used in accordance with this invention.

Small quantities of fluoride ions only are necessary to obtain the increased efficiency and electrode protection. Usually, fluoride ions are added in an amount of about 0.0002 to about 0.025 moles/L, preferably about 0.002 to about 0.01 moles/L. Such fluoride ions may be provided from any convenient source, such as hydrofluoric acid or its salts, for example, sodium fluoride or ammonium fluoride.

Higher temperatures tend to cause decomposition of the persulfate and hence loss of efficiency. For this reason, the electrolysis generally is effected below about 25° C., preferably about 5° to about 15° C. Cooling of the cell during electrolysis in the preferred temperature range may be effected in any convenient manner.

The electrical conditions employed to effect the electrolysis may vary over wide ranges of anode current density and applied voltage. Usually, the current density varies from about 100 to about 1500 mA/cm$^2$, preferably about 300 to about 1000 mA/cm$^2$.

The electrolysis may be effected in any convenient cell construction, usually a cell divided into anolyte and catholyte compartments by a suitable membrane. The catholyte may be an acidified water or other convenient electrolyte and any convenient electrode material may be used as the cathode.

As mentioned previously, Russian Patent No. 1,231,084 discloses electrosynthesis of persulfate using an anode constructed of highly-conductive thermoanthracite in the presence of ammonium fluoride additive. The electrode material employed is not glassy carbon and neither does the disclosure suggest the possibility of using glassy carbon. This prior art also suggests that there is an effective concentration range for the ammonium fluoride, namely from 0.05 to 0.6 mole/L, outside which the addition of ammonium fluoride does not produce so-called satisfactory current efficiencies (i.e. up to a quoted maximum of about 87%) and that an anodic current density of 0.5 to 0.65 A/cm$^2$ also is required. In contrast, with the glassy carbon anode of this invention, a much higher current efficiency (i.e. up to 97%) is obtained over a wider range of current density and most importantly at a fluoride concentration level which is lower by one order of magnitude than that recited in the patent. Accordingly, in the present invention, the persulfate electrosynthesis process is more economical and, at the same time, a substantially purer product is obtained than in the prior art.

The ability to employ a glassy carbon anode in the electrosynthesis of persulfate, as disclosed herein, provides an inexpensive alternative to the commercially-employed platinum anodes.

EXAMPLES

EXAMPLE 1

Electrolyses were effected in a divided H-cell using a NAFION (trademark) membrane as a separator. In the cathodic compartment, hydrogen was evolved at a platinum cathode from 5M sulfuric acid solution. The anolyte contained either sulfuric acid or ammonium sulfate, and optionally an oxygen evolution suppressant. The cell was cooled externally by means of an ice bath, to maintain the electrolyte temperature below 15° C. The anolyte was purged with nitrogen to remove traces of ozone formed. The anode was made from a glassy carbon rod of diameter 0.3 cm supplied by Carbone-Lorraine as V25 grade (obtained by pyrolysis at 2500° C.).

The electrolyses were carried out in a constant current mode, using a standard power supply (Hewlett Packard 6024A DC). The product was analyzed iodometrically. Due to the slow reaction between the peroxy salt and iodide, a very concentrated (6M) KI solution was used. Iodine liberated in the reaction was back titrated with sodium thiosulfate.

The results of these electrolyses are presented in the following Table I:

TABLE I

ELECTROSYNTHESIS OF PERSULFATE USING GLASSY CARBON ANODE

| Run No. | Current Density [mA/cm$^2$] | Voltage [V] | Temp. [°C.] | Electrolyte | Additive (NaF conc) [gpL] | Duration of Electrolysis [min] | Current Efficiency % | Electrode Stability |
|---|---|---|---|---|---|---|---|---|
| 1 | 300 | 16 | 10 | 4 M $(NH_4)_2SO_4$ | 0.4 | 15 | 96 | stable |
| 2 | 300 | 20 | 7 | same | 0.4 | 15 | 96 | stable |
| 3 | 300 | 16 | 15 | same | 0.4 | 300 | 97 | stable |
| 4 | 300 | 9 | 7 | 5 M $H_2SO_4$ | 0.4 | 15 | 97 | stable |
| 5 | 300 | 9 | 7 | same | 0.4 | 66 | 90 | stable |
| 6 | 300 | 11 | 15 | same | 0.4 | 130 | 82 | stable |
| 7 | 300 | 17 | 10 | 4 M $(NH_4)_2SO_4$ | — | 15 | 23 | disintegrated slowly |
| 8 | 300 | 17 | 10 | 5 M $H_2SO_4$ | — | 15 | 10 | disintegrated rapidly |

As may be seen from the results presented in Table I, fluoride ions are necessary to enable a high current efficiency to be obtained and electrode stability to be maintained. Current efficiencies in excess of 80%, and in most instances in excess of 90%, were obtianed.

EXAMPLE 2

The electrolysis procedure of Example 1 was repeated, except that known oxygen evolution suppressants, namely ammonium thiocyanate, thiourea and fluoroboric acid, were substituted for the sodium fluoride. No significant improvement in current efficeincy and electrode stability were observed as compared with the absence of any additive, leading to the conclusion that fluoride ions alone are effective when glassy carbon is used as the anode.

EXAMPLE 3

The electrolysis procedure of Example 1 was repeted except that a glassy carbon anode provided by Sigri Corporation (Sigradur G) was substituted for the Carbone-Lorraine V25 material Current efficiencies in excess of 95% with no noticeable deterioration were obtained in the presence of small amounts of sodium fluoride.

SUMMARY OF DISCLOSURE

In summary of this disclosure, the present invention provides a novel method of making peroxydisulfuric acid and its salts at high current efficiency by electrosynthesis from an aqueous acid solution of sulfate ions using a glassy carbon anode in the presence of fluoride ions. Modifications are possible within the scope of this invention.

What I claim is:

1. A method for the production of peroxydisulfuric acid or a salt thereof, which comprises electrolyzing an aqueous acid reaction medium containing sulfate ions using an anode having a glassy carbon surface in the presence of an oxygen evolution-inhibiting amount of fluoride ions to form peroxydisulfate ions at said anode.

2. The method of claim 1 wherein said sulfate ions are provided at least in part by a water-soluble sulfate salt present and the sulfate ion concentration from said water-soluble sulfate is from about 10 to about 800 gpL.

3. The method of claim 2 wherein said sulfate ion concentration is from about 300 to about 600 gpL.

4. The method of claim 3 wherein said water-soluble sulfate is ammonium sulfate.

5. The method of claim 1 wherein said reaction medium contains sulphuric acid in a concentration of about 1 to about 12 molar.

6. The method of claim 5 wherein said sulphuric acid is present in a concentration of about 5 to about 8 molar.

7. The method of claim 1 wherein said fluoride ions are present in said reaction medium in a concentration of about 0.0002 to about 0.025 moles/L.

8. The method of claim 7 wherein said fluoride ion concentration is from about 0.002 to about 0.01 moles/L.

9. The method of claim 8 wherein said fluoride ions are provided by ammonium fluoride.

10. The method of claim 1 effected at a temperature of about 5° to 15° C.

11. A method for the production of peroxydisulfuric acid, a salt thereof or a mixture of said acid and salt, which comprises electrolyzing at a temperature below about 25° C. an aqueous acid reaction medium having a pH below about 5 and containing sulfate ions provided by a sulfate ion source selected from a water-soluble sulfate, sulphuric acid and a mixture thereof using an anode having a glassy carbon surface in the presence of about 0.0002 to about 0.025 moles/L of fluoride ions to form peroxydisulfate ions at said anode.

12. The method of claim 11 wherein said water-soluble sulfate, when present, provides a sulfate ion concentration of about 300 to about 600 gpL, said sulphuric acid, when present, is present in a concentration of about 5 to about 8 molar, and said fluoride ions are present in a concentration of about 0.002 to about 0.01 moles/L.

* * * * *